US005515696A

United States Patent [19]

Hutchison

[11] Patent Number: 5,515,696

[45] Date of Patent: May 14, 1996

[54] RECEIVER/DRIER/FILTER ASSEMBLY

[75] Inventor: Wayne K. Hutchison, Ingersoll, Canada

[73] Assignee: Eaton Corporation, Cleveland, Ohio

[21] Appl. No.: 288,634

[22] Filed: Aug. 10, 1994

[51] Int. Cl.[6] ..... F25B 39/04; F25B 43/00

[52] U.S. Cl. ..... 62/509; 62/298; 62/474; 285/137.1; 285/179

[58] Field of Search ..... 62/509, 474, 503, 62/298; 285/28, 30, 137.1, 180, 179, 212, 405

[56] References Cited

U.S. PATENT DOCUMENTS

| | | | |
|---|---|---|---|
| 4,528,826 | 7/1985 | Avery, Jr. | 62/503 |
| 4,707,999 | 11/1987 | Ohta et al. | 62/509 X |
| 4,920,766 | 5/1990 | Yamamoto et al. | 62/474 |
| 5,146,766 | 9/1992 | Martins | 62/298 |

FOREIGN PATENT DOCUMENTS

| | | | |
|---|---|---|---|
| 6-194005 | 7/1994 | Japan | 62/298 |

*Primary Examiner*—Harry B. Tanner
*Attorney, Agent, or Firm*—Roger A. Johnston

[57] ABSTRACT

A receiver/drier/filter assembly for a refrigeration system such as a vehicle air conditioner and having a canister containing desiccant welded to a header having an inlet and outlet port. A tubular elbow with an annular convolution adjacent one end is received in the inlet and outlet port with the convolution sealing against a resilient seal ring in each port. A bracket with generally oppositely disposed bent up flanges has an L-shaped slot in each flange. The bracket is attached to the header with each slot having one of the elbows received therein and the edges of the slot bearing against the annular convolution for retaining the elbow in the port. The opposite end of each elbow extends through the vertical portion of the L-shaped slot and is oriented generally radially with respect to the port by the sides of the bracket slot.

10 Claims, 1 Drawing Sheet

RECEIVER/DRIER/FILTER ASSEMBLY

BACKGROUND OF THE INVENTION

The present invention relates to receiver/drier/filters for refrigeration systems and particularly refrigeration systems employed for air conditioning the passenger compartment of vehicles. Typically, vehicle air conditioning systems have the receiver/drier/filter connected in the refrigerant lines between the condenser or exothermic heat exchanger and the expansion device and thus have liquid refrigerant at the high pressure from the compressor flowing through the receiver/drier/filter.

In the design of air conditioning systems for mass production of motor vehicles, it has been desired for reliability, ease of assembly and low manufacturing costs to provide for a way to quickly assemble the receiver/drier/filter in the system at installation in the vehicle. In certain vehicle installations it has been found necessary due to space constraints to provide for right angle fittings or elbows with respect to the longest dimension of the receiver/drier/filter and to provide for proper orientation of such fittings. In such installations, it has further been desired to provide a reliable, low cost way of attaching such right angle fittings to the receiver/drier/filter, of properly orienting same for installation in the vehicle; and, it has also been desired in such installations to minimize the number of parts required and to provide for permanent positive sealing of the refrigerant conduit attachment fittings to the receiver/drier/filter.

Heretofore, fittings have been attached to the top or header of a receiver/drier/filter by such techniques as threaded fittings, brazing, welding, clamping blocks and crimping over an annular convolution formed on the tubular fitting to be attached. All of these known techniques have required complex tooling and jigging fixtures for orienting the right angle fittings or elbow fittings upon attachment to the receiver/drier/filter. Thus it has been desired to provide a way which facilitates assembly of right angle or elbow fittings to a receiver/drier/filter which eliminates the need for special tools or fixtures to maintain the orientation of the fittings for connection to the refrigeration system conduits, particularly in vehicle air conditioning systems.

SUMMARY OF THE INVENTION

It is an object of the present invention to provide a receiver/drier/filter assembly for connection between the exothermic heat exchanger or condenser and the expansion device of a refrigerant system for enabling flow of high pressure side liquid refrigerant through the receiver/drier/filter.

It is another object of the invention to provide a receiver/drier/filter assembly for a refrigeration system of the type employed in vehicle air conditioners having right angle or elbow fittings for connecting the refrigerant lines to the receiver/drier/filter.

It is a further object of the invention to provide a receiver/drier/filter assembly which provides for ease of assembly of right angle elbows to a receiver/drier/filter and provides for automatic orientation of the elbows with respect to the receiver/drier/filter.

It is a further object of the present invention to minimize the number of parts required to connect and orient right angle refrigerant line fittings to a receiver/drier/filter assembly for a refrigeration system.

It is another object of the present invention to provide a unitary mounting bracket attachable to a receiver/drier/filter for a refrigeration system and which secures, orients, and effects sealing of tubular elbow fittings thereon for connection to the system refrigerant lines.

The present invention provides a receiver/drier/filter assembly for a refrigeration system and is particularly suitable for use in a motor vehicle air conditioning system. The receiver/drier/filter assembly of the present invention is of the canister-type having a header attached to the canister with an inlet and an outlet port formed in the header for receiving right angle or tubular elbow fittings therein for connection to the refrigerant lines in the vehicle air conditioning system.

The assembly is of the type having a header with the inlet and outlet port formed therein with a standpipe attached to the outlet port and a canister containing desiccant and filter material attached to the header and sealed thereabout preferably by welding. The inlet and outlet port each have a resilient seal ring disposed therein. A tubular elbow fitting is provided for each of the inlet and outlet ports; and, the elbows have the end thereof inserted into the port respectively provided with an annular convolution formed therearound for contacting and sealing against the seal ring. A retaining bracket has a pair of generally oppositely disposed, flanges, each flange having a generally L-shaped slot provided therein. The bracket is attached to the header by suitable fastening means with the inlet and outlet elbow fittings received respectively in one of the slots for orientation thereby with respect to the receiver/drier/filter. The edges of the bracket slots bear against the annular convolutions to retain the ends of the elbows retained in the ports and against the seal rings.

DETAILED DESCRIPTION

Figures 1, 2, 3, 4:
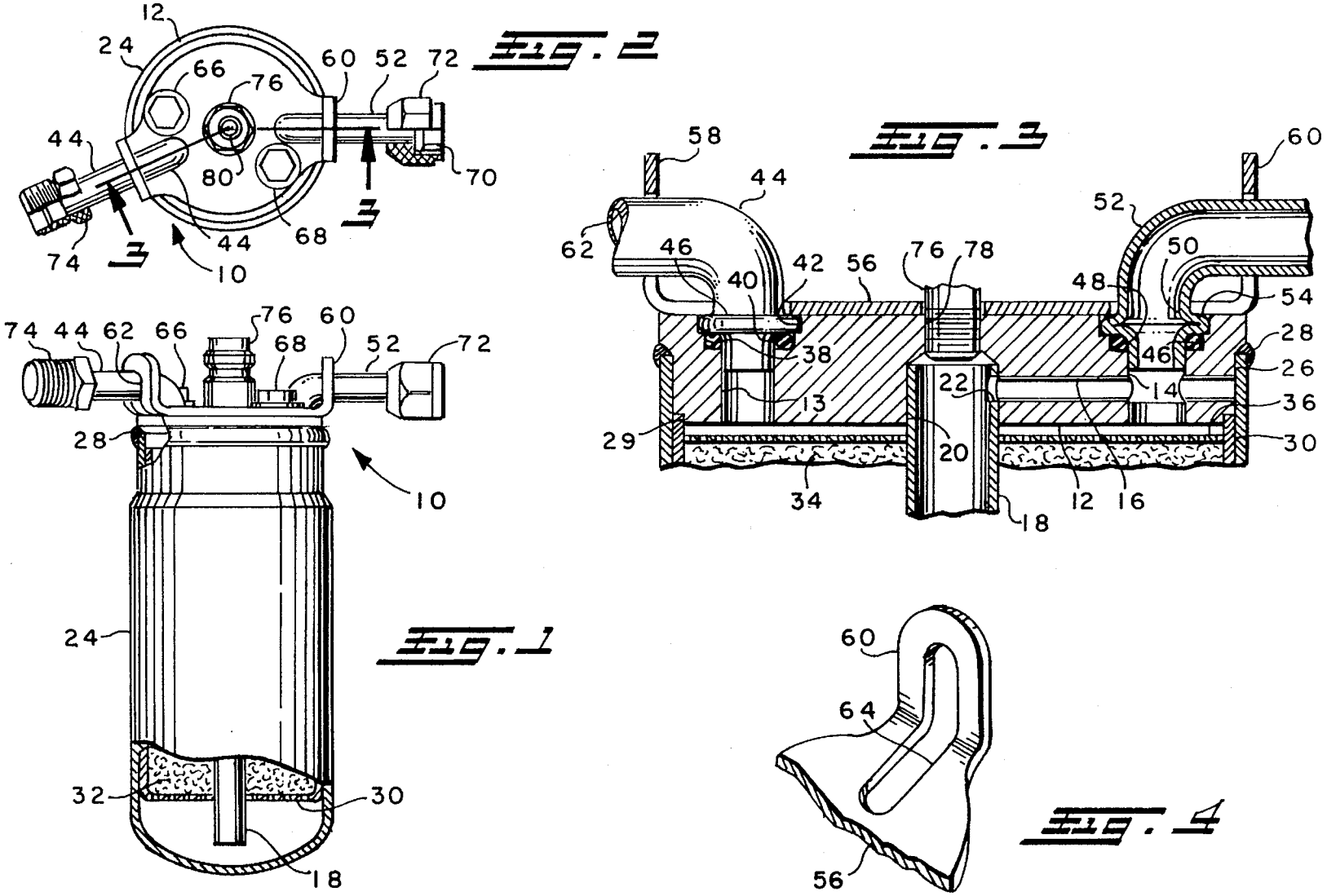
FIG. 1 is a side view in elevation of the receiver/drier/filter assembly of the present invention with portions of the canister broken away.
FIG. 2 is a top view of the assembly of FIG. 1.
FIG. 3 is a portion of an enlarged section view taken along section indicating lines 3—3 of FIG. 2; and, FIG. 4 is a perspective view of a portion of the mounting bracket of the assembly of FIG. 1.

Referring to FIGS. 1–4, the receiver/drier/filter assembly of the present invention is indicated generally at 10 and comprises a header or block 12 having formed therein an inlet port 13 and outlet port 14, it being understood that the inlet port 13 is disposed generally oppositely of the center of the header 12 from the outlet port 14. Outlet port 14 communicates with a cross-bore or passage 16 which communicates with a standpipe 18 connected in a central bore 20 provided in the header. A cross-hole 22 in the standpipe communicates the interior of the standpipe with the cross-bore 16 as shown in FIG. 3. The lower end of standpipe 18 is visible in FIG. 1. A canister 24, is received over a reduced diameter 26 or shoulder formed on the header; and, the end of the canister 24 is sealed and secured on the header by suitable expedient as, for example weldment denoted by reference numeral 28 in FIGS. 1 and 3.

The canister 24 has disposed therein a perforated basket 30 which is connected to the underside of header 12 preferably over a reduced diameter or shoulder 29 and secured thereon by any suitable expedient as, for example crimping, staking or weldment. Basket 30 has disposed therein suitable desiccant denoted by reference numeral 32 and any desired filter material 34 a portion of which is visible in FIG. 3 adjacent the perforated cover 36 of basket 30.

The inlet port 13 has a first counter bore 38 formed therein in which is received a resilient seal ring 40; and, a second counter bore 42 is formed in port 13 at the upper surface of the header 12 and which is significantly larger than the counter bore 38. A tubular inlet elbow 44 has an enlarged annular bulge or convolution 46 formed adjacent one end thereof. Elbow 44 has the end adjacent the convolution 46 inserted or received in port 13; and, the convolution 46 has one axial face thereof registered against the seal ring 40 for compressing same in the axial or vertical direction in FIG. 3. It will be understood that inlet elbow 44 has the end thereof piloted in port 13 and may be rotated therein.

Referring to FIG. 3, outlet port 14 has a counter bore 46 formed therein with a resilient seal ring 48 received therein. A second counter bore 50 is formed in port 14 at the upper face of header 12 which counter bore is significantly larger than the counter bore 46. Tubular outlet elbow 52 has an enlarged annular bulge or convolution 54 formed adjacent one end thereof. The end of elbow 52 adjacent convolution 54 is inserted in counter bore 50 such that the axial face thereof bears against resilient seal ring 48. It will be understood that the end of the elbow 52 is piloted in the port 14; and, the elbow may be rotated in the port.

A bracket 56 preferably formed of flat sheet or plate stock has a pair of generally oppositely disposed upturned right angle flanges with one flange 58 located in a position radially aligned with the inlet port 13 and the opposite flange 60 located in a position radially aligned with the outlet port 14. Flange 58 has an L-shaped cut-out or slot 62 formed therein which is of sufficient width and is sized to receive therein the elbow 44 in a vertical direction. Bracket 56 is registered against the upper surface of the header 12 with the horizontal edges of the slot 62 bearing against the annular convolution 46 on the elbow and retaining the convolution in counter bore 42 and compressed against the seal ring 38. The vertical sides size of slot 62 serve to orient the outward end of elbow 44 in the radial direction from inlet 13 and to maintain the elbow in that position.

Similarly, the bracket flange 60 has a cut-out or slot 64 having a generally L-shaped configuration formed therein and which has the width thereof of sufficient width and is sized to enable the bracket 56 to be received vertically over the outlet elbow 52. The horizontal edges of slot 64 bear against the axial edge of convolution 54; and, the vertical sides of slot 64 serve to orient the outward end of elbow 52 in a radial direction with respect to outlet port 14 and to maintain the elbow in this position. Bracket 56 is retained on the header by suitable fastening means, as for example, cap screws 66,68 threaded into the upper surface of the header 12.

In the presently preferred practice, the outlet elbow 52 has an internally threaded fitting 72 for attachment thereto rotatably received over the outstanding end of the elbow 52 and retained thereon by a second convolution 70 provided on the outstanding end of the elbow 52. The fitting 72 may be of any desired type for high pressure tubing connection. Similarly, if desired, an externally threaded high pressure tube fitting 74 may be rotatably provided on to the end of inlet elbow 44 and retained thereon by flaring the end of elbow 44 therein or by any other suitable expedient known in the art of high pressure tube connections.

If desired, a charging fitting 76 may be provided in the center of header 12 and threadedly engaging a port 78 provided in the header to permit charging of the system. Typically, the fitting 76 has a one-way ball check valve 80 provided therein for permitting one-way flow of refrigerant into the interior of the canister upon attachment of a suitable charging line (not shown) to the fitting 76.

The present invention thus provides a unique and novel way of providing for conduit attachment to a receiver/drier/filter for a refrigeration system having right angle fittings or elbows connected to the inlet and outlet port of the receiver/drier/filter. The elbow fittings are retained thereon and maintained in proper orientation by a one-piece bracket received thereover and fastened to the surface of the receiver/drier/filter. The present invention provides a structure easy to assemble and install which is particularly suitable for refrigeration systems and in particular air conditioning systems installed in the mass production of motor vehicles.

Although the present invention has been described hereinabove with respect to the illustrated embodiments and the presently preferred practice, it will be understood that the invention is capable of modification and variation and is limited only by the following claims.

I claim:

1. A receiver/drier/filter assembly for connection to refrigerant conduits comprising:

(a) a header having an inlet port therethrough and an outlet port spaced from said inlet port;

(b) a resilient seal disposed in each of said inlet and outlet ports;

(c) an inlet and an outlet tubular elbow each having an annular convolution formed thereon adjacent one end, with said one end received respectively in said inlet and outlet port;

(d) a bracket having a first and second upturned spaced flange formed thereon, with said first flange having a slotted portion received over said inlet elbow and said second flange having a slotted portion received over said outlet elbow, said slotted portion operative to orient said elbows;

(e) fastening means securing said bracket to said header wherein said first slotted portion of said first flange bears against said first inlet elbow convolution effecting sealing in said inlet port and said second slotted portion bears against said outlet elbow convolution effecting sealing in said outlet port; and, (f) a canister attached to and sealed about said header, said canister containing desiccant.

2. The receiver/drier/filter assembly defined in claim 1, wherein said header includes a standpipe attached thereto with a passage communicating said standpipe with said outlet port.

3. The receiver/drier/filter assembly defined in claim 1, wherein said header includes a charging port with a charging fitting and said bracket has a clearance aperture for permitting assembly over said charge fitting.

4. The receiver/drier/filter assembly defined in claim 1, wherein said first and second flange are formed generally oppositely disposed on said bracket.

5. The assembly defined in claim 1, wherein said bracket means includes a pair of generally oppositely disposed flanges, and said first cut-out comprises a slot in one of said flanges and said second cut-out comprises a slot in the other of said flanges.

6. The assembly defined in claim 1, wherein said header has a charging port formed thereon with a charging fitting extending therefrom intermediate said inlet and outlet port; and, said bracket means has a third cut-out therein with said charging fitting received therethrough.

7. The assembly defined in claim 1, wherein said canister is welded to said header.

8. The assembly defined in claim 1, wherein one of said inlet and outlet elbows has an attachment fitting rotatably received over the end thereof remote from said header, said attachment fitting retained on the elbow by a second annular convolution formed thereon.

9. A receiver/drier/filter assembly connectable to refrigerant conduits for flow of refrigerant therethrough comprising:

(a) a header having an inlet port therethrough and an outlet port spaced from said inlet port;

(b) a resilient seal disposed in each of said inlet and outlet port;

(c) an inlet and outlet tubular elbow each having a convolution formed thereon adjacent one end, with said one end received respectively in said inlet and outlet port with said convolution contacting respectively said seal;

(d) bracket means having a first and second cut-out formed therein with said first cut-out having said inlet elbow received therein and oriented thereby and said second cut-out having said outlet elbow received therein and oriented thereby, said bracket means contacting said first and second elbow convolutions and retaining said elbows respectively in said ports; and, (e) fastening means operable for securing said bracket means on said header.

10. A method of making a receiver/drier/filter for a refrigeration system comprising:

(a) providing a canister containing desiccant with an inlet and outlet port;

(b) disposing a resilient seal in said inlet and outlet port;

(c) forming a convolution on an inlet and outlet elbow and inserting said elbows in said ports with the convolution against said resilient seal;

(d) forming an inlet and outlet cut-out in a bracket and assembling the bracket on said canister with the elbows received through the cut-outs and orienting said elbows directionally with the edges of said cut-outs; and, (e) securing said bracket on said canister and pressing said cut-out edges against said convolutions and sealing said elbows in said ports.

* * * * *